US007324010B2

(12) United States Patent
Gardner et al.

(10) Patent No.: US 7,324,010 B2
(45) Date of Patent: Jan. 29, 2008

(54) ACOUSTIC TELEMETRY SYSTEMS AND METHODS WITH SURFACE NOISE CANCELLATION

(75) Inventors: Wallace R. Gardner, Houston, TX (US); Don Herrick Johnson, Houston, TX (US); Vimal V. Shah, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 53 days.

(21) Appl. No.: 10/984,056

(22) Filed: Nov. 9, 2004

(65) Prior Publication Data

US 2006/0098531 A1 May 11, 2006

(51) Int. Cl.
*G01V 11/00* (2006.01)

(52) U.S. Cl. ..... 340/854.4; 367/82; 166/250.15

(58) Field of Classification Search ..... 340/854.4; 367/82, 83, 43; 166/250.15, 106
See application file for complete search history.

(56) References Cited

U.S. PATENT DOCUMENTS 4,878,206 A 10/1989 Grosso et al.
5,274,606 A * 12/1993 Drumheller et al. ..... 367/82
5,774,420 A 6/1998 Heysse et al.
6,370,082 B1 4/2002 Gardner et al.
6,715,550 B2 * 4/2004 Vinegar et al. ..... 166/250.15
6,781,520 B1 * 8/2004 Smith et al. ..... 340/853.1
2004/0155794 A1 8/2004 Gardner
2005/0024232 A1 * 2/2005 Gardner et al. ..... 340/854.4

* cited by examiner

*Primary Examiner*—Brian Zimmerman
*Assistant Examiner*—Hung Q Dang
(74) *Attorney, Agent, or Firm*—Krueger Iselin LLP

(57) ABSTRACT

Acoustic telemetry systems and methods with surface noise cancellation. One illustrative embodiment may include an acoustic telemetry system comprising a transmitter configured to generate an acoustic information signal that propagates along a drillstring, and a receiver configured to detect an acoustic receive signal from the drillstring and a noise signal from a surface environment. The receiver operates on the acoustic receive signal and the noise signal to produce a modified signal indicative of the acoustic information signal and having a reduced noise content relative to the acoustic receive signal.

21 Claims, 5 Drawing Sheets

ACOUSTIC TELEMETRY SYSTEMS AND METHODS WITH SURFACE NOISE CANCELLATION

BACKGROUND

Modern petroleum drilling and production operations demand a great quantity of information relating to parameters and conditions downhole. Such information typically includes characteristics of the earth formations traversed by the wellbore, along with data relating to the size and configuration of the borehole itself. The collection of information relating to conditions downhole is referred to as "logging."

Logging frequently is done during the drilling process, eliminating the necessity of removing or "tripping" the drilling assembly to insert a wireline logging tool to collect the data. Data collection during drilling also allows the driller to make accurate modifications or corrections as needed to optimize performance while minimizing down time. Designs for measuring conditions downhole including the movement and location of the drilling assembly contemporaneously with the drilling of the well have come to be known as "measurement-while-drilling" techniques, or "MWD". Similar techniques, concentrating more on the measurement of formation parameters, commonly have been referred to as "logging while drilling" techniques, or "LWD". While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other downhole parameters, such as the temperature and the pressure at the base of the borehole, for example. Once this data is gathered at the bottom of the borehole, it is typically transmitted to the surface for use and analysis by the driller.

Sensors or transducers typically are located at the lower end of the drillstring in LWD systems. While drilling is in progress these sensors continuously or intermittently monitor predetermined drilling parameters and formation data and transmit the information to a surface detector by some form of telemetry. Typically, the downhole sensors employed in LWD applications are positioned in a cylindrical drill collar that is positioned close to the drill bit. The LWD system then employs a system of telemetry in which the data acquired by the sensors is transmitted to a receiver located on the surface. There are a number of telemetry systems in the prior art that seek to transmit information regarding downhole parameters up to the surface without requiring the use of a wireline tool. These include the mud pulse telemetry system and the through-drillstring telemetry system.

The mud pulse telemetry system creates acoustic pressure signals in the drilling fluid that is circulated under pressure through the drillstring during drilling operations. The information that is acquired by the downhole sensors is transmitted by suitably timing the formation of pressure pulses in the mud stream. The information is received and decoded by a pressure transducer and computer at the surface.

The through-drillstring telemetry system transmits data using vibrations in the tubing wall of the drillstring. The vibrations are generated by an acoustic transmitter (e.g., piezoelectric washers) mounted on the tubing wall of the drillstring and are transmitted upstream to an acoustic receiver (e.g., an accelerometer), also mounted on the drillstring tubing wall. Several transmitter/receiver pairs may be positioned along the length of the drillstring acting as repeaters. The information is received and decoded by an acoustic receiver and computer at the surface.

Because these systems are acoustic in nature, their signals are susceptible to distortion by ambient noise and vibration. In an environment such as a drilling rig there can be a large variety of acoustical noise and vibration sources. The presence of noise and vibrations in the drillstring due to activities surrounding the drilling process severely hinders the detection of acoustic telemetry signals.

SUMMARY

The problems noted above are addressed in large part by acoustic telemetry systems and methods with surface noise cancellation. One illustrative embodiment may include an acoustic telemetry system comprising a transmitter configured to generate an acoustic information signal that propagates along a drillstring, and a receiver configured to detect both an acoustic receive signal from the drillstring and a noise signal from a surface environment. The receiver operates on the acoustic receive signal and the noise signal to produce a modified signal indicative of the acoustic information signal and having a reduced noise content relative to the acoustic receive signal.

Another illustrative embodiment may include a downhole telemetry method that comprises: generating a first information-carrying acoustic signal that propagates along a drillstring; detecting a second information-carrying acoustic signal that correlates to the first information-carrying signal; receiving a surface noise signal from the drilling site environment; combining the surface noise signal with the second information-carrying signal to produce a third information-carrying signal having a reduced noise content; and demodulating the third information-carrying signal.

BRIEF DESCRIPTION OF THE DRAWINGS

For a detailed description of the various embodiments of the invention, reference will now be made to the accompanying drawings in which.

NOTATION AND NOMENCLATURE

Certain terms are used throughout the following discussion and claims to refer to particular system components. This document does not intend to distinguish between components that differ in name but not function.

In the following discussion and in the claims, the terms "including" and "comprising" are used in an open-ended fashion, and thus should be interpreted to mean "including but not limited to . . . ." Also, the term "couple" or "couples" is intended to mean either an indirect or direct electrical connection. Thus, if a first device couples to a second device, that connection may be through a direct electrical connection, or through an indirect electrical connection via other devices and connections.

The terms upstream and downstream refer generally, in the context of this disclosure, to the transmission of information from subsurface equipment to surface equipment, and from surface equipment to subsurface equipment, respectively. The terms surface and subsurface are relative terms. The fact that a particular piece of hardware is described as being on the surface does not necessarily mean it must be physically above the surface of the Earth; but rather, describes only the relative placement of the surface and subsurface pieces of equipment.

The term "noise", as used in this disclosure, is meant to indicate a signal that is largely unrelated to the desired information and interferes with the reception or decoding of a signal comprising desired information. Thus, even though an interfering signal may not be random or spurious in nature, and may in fact contain coherent information, the interfering signal is considered noise if the signal is not the desired signal or information, and it interferes with the desired signal or with decoding of the desired information.

DETAILED DESCRIPTION

Figure 1:
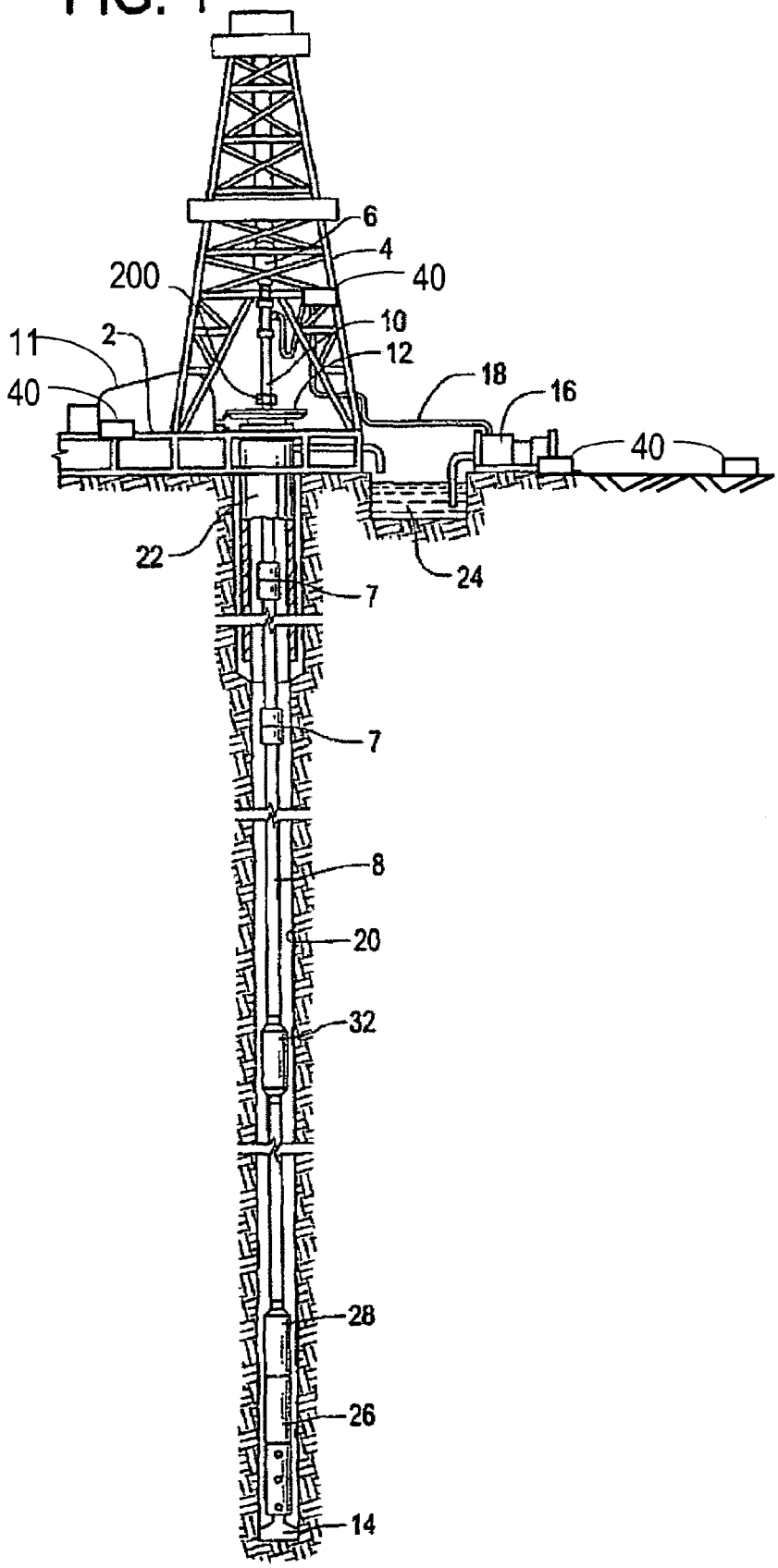
FIG. 1 is a schematic view of an oil well in which an acoustic telemetry system, constructed in accordance with at least some embodiments, may be employed.

Turning now to the figures, FIG. 1 shows a well during drilling operations. A drilling platform 2 is equipped with a derrick 4 that supports a hoist 6. Drilling of oil and gas wells is carried out by a string of drill pipes connected together by "tool" joints 7 so as to form a drillstring 8. The hoist 6 suspends a kelly 10 that is used to lower the drillstring 8 through rotary table 12. Rotating table motor 11 may rotate rotary table 12 from the side as shown in FIG. 1, or may also do so from above the rotary table, alternatively mounted on Kelly 10 (not shown). Connected to the lower end of the drillstring 8 is a drill bit 14. The bit 14 is rotated and drilling accomplished by rotating the drillstring 8, by use of a downhole motor near the drill bit, or by both methods. Drilling fluid, termed mud, is pumped by mud recirculation equipment 16 through supply pipe 18, through drilling kelly 10, and down through the drillstring 8 at high pressures and volumes (e.g., 3000 p.s.i. at flow rates of up to 1400 gallons per minute) to emerge through nozzles or jets in the drill bit 14. The mud then travels back up the hole via the annulus formed between the exterior of the drillstring 8 and the borehole wall 20, through the blowout preventer 22, and into a mud pit 24 on the surface. On the surface, the drilling mud is cleaned and then recirculated by recirculation equipment 16. The drilling mud is used to cool the drill bit 14, to carry cuttings from the base of the bore to the surface, and to balance the hydrostatic pressure in the rock formations.

Downhole sensors 26 are coupled to an acoustic telemetry transmitter 28 that transmits telemetry (e.g., information-carrying) signals in the form of acoustic vibrations in the tubing wall of drillstring 8. An acoustic telemetry receiver 200 is coupled to the kelly 10 to receive transmitted acoustic telemetry signals. One or more repeater modules 32 may be provided along the drillstring to receive and retransmit the acoustic telemetry signals. The repeater modules 32 include both an acoustic telemetry receiver and an acoustic telemetry transmitter configured similarly to receiver 200 and the transmitter 28.

Telemetry transmissions from either the transmitter 28 or the repeater modules 32 may comprise data sent as it is collected ("continuous" or "real-time" data), data stored and transmitted after a delay ("buffered" or "historical" data), or a combination of both, each transmitted at different times during drilling operations. LWD data collected during actual drilling may be collected at a relatively high resolution (e.g., one sample for every six inches of penetration), and saved locally in memory (e.g., within the downhole sensor 26, the transmitter 28, or any of the repeaters 32). This high-resolution data may be needed in order to perform a meaningful analysis of the downhole formations. But because of the limited bandwidth of downhole telemetry systems, the data may have to be transmitted at a much lower resolution (e.g., one sample every four feet). In at least some embodiments the data may be saved at a higher resolution as described above, and transmitted to the surface at a later time when the tool is still downhole, but while drilling is not taking place (e.g., when a tool gets stuck or when the hole is being conditioned). This historical transmission may be at a sample resolution higher than the resolution normally used for real-time data transmission.

When drilling is not taking place, there generally is no real-time data being transmitted. During this time selected portions of saved data may be transmitted or retransmitted to the surface. Since this is not real-time data, the only time restriction on the transmission is the time available before drilling and real-time data transmission resume. Thus, for example, a selected, one-hour window of data saved in memory and collected at a resolution of one sample every six inches may be transmitted to the surface, even though it may take multiple hours to transmit the data.

The data may be transmitted in chronological or reverse chronological order, and may be transmitted at any resolution desired. For example, all the data may be transmitted for maximum resolution, or every other sample may be transmitted for better but not maximum resolution. The resolution selected generally represents a trade-off between the time available to retrieve the saved data and the resolution needed to properly analyze the data. Also, any start and stop point may be selected within the memory where the data is saved (each location in memory correlating to a measured parameter sampled at a specific drilling time and depth).

The downhole sensor 26, transmitter 28 and repeaters 32 may be adapted to acoustically receive commands transmitted from the surface. These commands may control the suspension of real-time data collection and/or transmission, the selection of saved data, the selection of the desired resolution of data transmission, the initiation of saved data transmission, the suspension of saved data transmission, and the resumption of real-time data collection and/or transmission.

As can be seen from FIG. 1, the nature of drilling operations creates a noisy environment. Noise present during drilling operations may include the noise produced by the drill bit 14, noise from pumps such as those used by the mud recirculation equipment 16, and noise from activities on the drilling platform 2 to name just a few. Activities adjacent to the drilling rig may also produce noise, such as the operation of heavy equipment on the site and generators providing electrical power. Much of the noise described is produced at the surface of the drill site. Sensors 40 may be placed at various locations throughout the drill site as shown so as to detect the "surface noise" near the sources of noise. Such locations may include the derrick 4, the rotating table motor 11, the recirculation equipment 16, and the ground near the drilling platform 2. The sensors may include, for example, accelerometers mounted on the equipment, microphones place around the site, and geophones inserted into the ground. By placing the sensors 40 near each of the noise sources, the surface noise may be distinguished from the telemetry signal and drill bit noise propagated along the drillstring. The noise from each source thus detected may then be combined and used as a noise reference signal for an adaptive noise-canceling receiver within an acoustic telemetry system.

Figure 2:
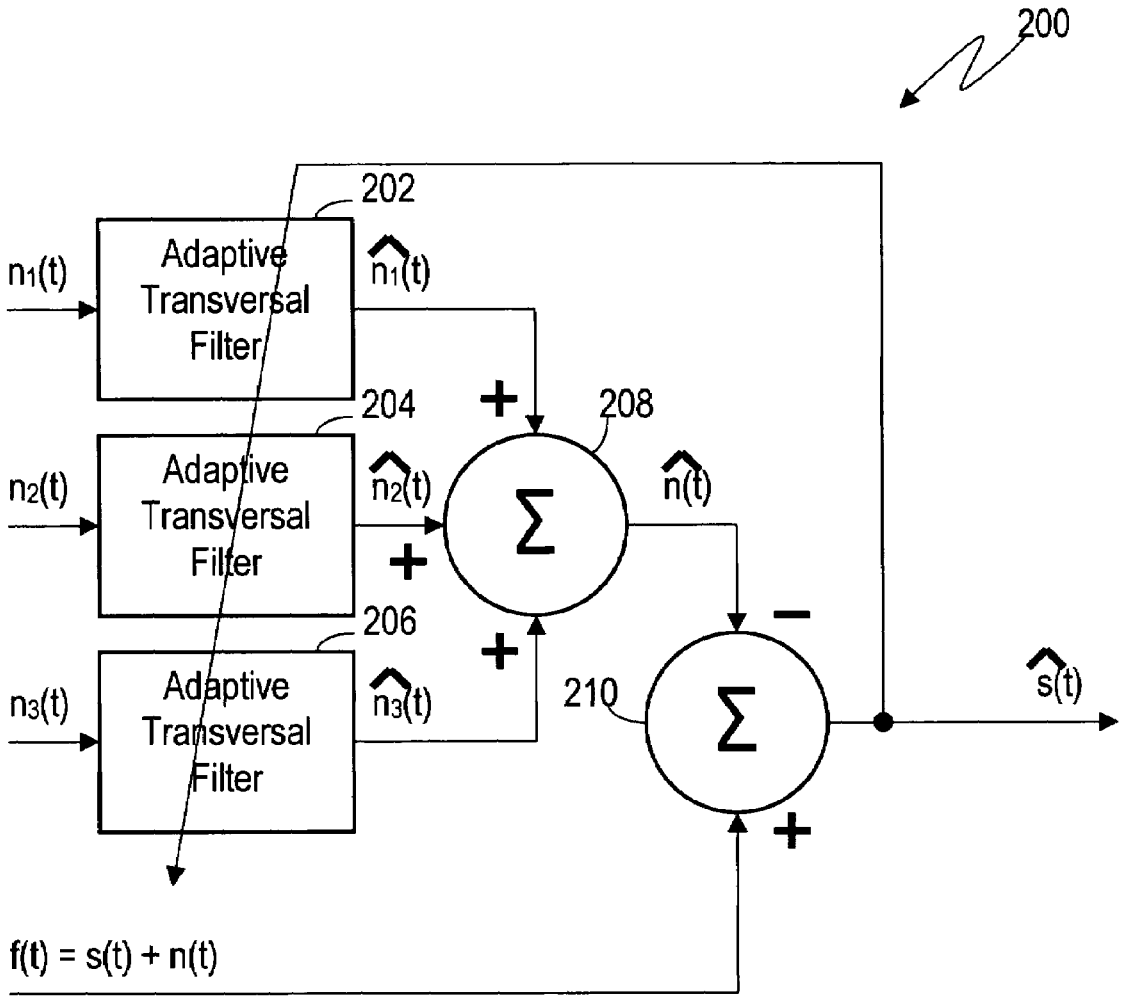
FIG. 2 illustrates a simplified functional diagram of an adaptive noise canceling receiver for an acoustic telemetry system constructed in accordance with at least some embodiments.

FIG. 2 illustrates an adaptive noise-canceling receiver 200 for a through-drillstring acoustic telemetry system constructed in accordance with at least some embodiments. Noise is detected by a plurality of sensors placed in proximity to a drilling rig comprising a through-drillstring acoustic telemetry system. The noise sensors may couple to the receiver 200 using electrical or optical cables. The noise sensors each may also comprise a radio frequency antenna that may be used to wirelessly couple the sensors to the receiver 200. As shown in the embodiment of FIG. 2, each of the individual noise signals $n_1(t)$, $n_2(t)$, and $n_3(t)$ are respectively coupled to the input of adaptive transversal filters 202, 204, and 206. Each filter output $\hat{n}_1(t)$, $\hat{n}_2(t)$, and $\hat{n}_3(t)$ represents an estimate by the corresponding filter of the contribution of that noise source to the actual noise n(t) that is present at the receiver 200 on drillstring 8 (FIG. 1). Each filter output is coupled to an input of summing node 208, and the output of summing node 208 couples to summing node 210 at one of its two inputs. The output of summing node 208 is the estimated noise $\hat{n}(t)$ and approximates the actual noise n(t). The input signal $f(t)$ (comprising the actual noise n(t) plus the telemetry signal s(t) received by the receiver 200 on drillstring 8) couples to summing node 210 at its remaining input and combines with the negative of the estimated noise $\hat{n}(t)$, resulting in an estimated telemetry signal $\hat{s}(t)$. This is represented by the equation:

$$\hat{s}(t)=s(t)+n(t)-\hat{n}(t) \tag{1}$$

The estimated signal $\hat{s}(t)$ couples back as an input to each of the adaptive transversal filters 202, 204 and 206. The estimated signal $\hat{s}(t)$ operates as an error measurement that is used by each of the adaptive transversal filters as a basis for reducing the error between the estimated signal $\hat{s}(t)$ and the actual signal s(t).

Figure 3:
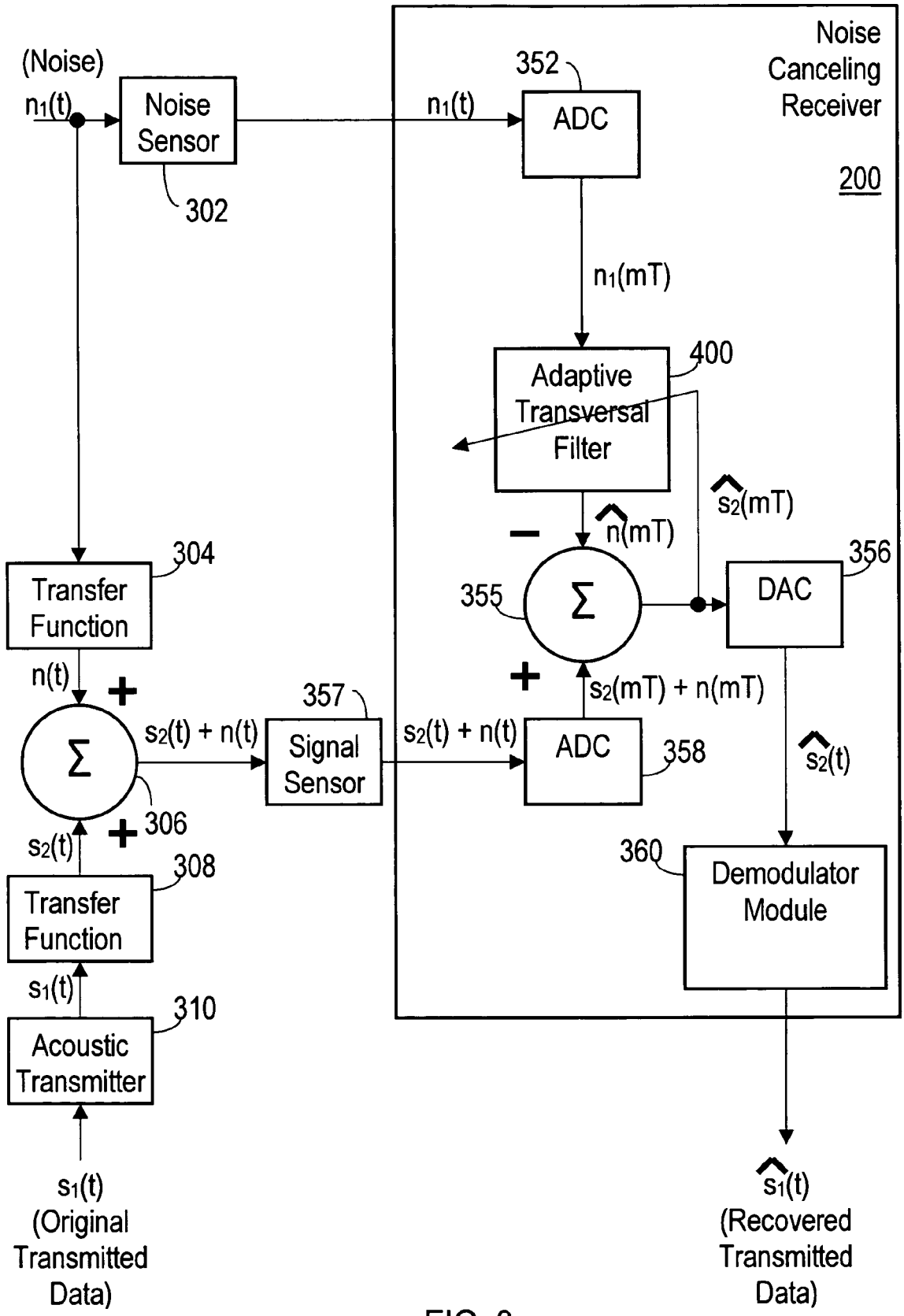
FIG. 3 illustrates a detailed functional diagram of an adaptive noise canceling receiver for an acoustic telemetry system constructed in accordance with at least some embodiments.

Equation (1) expresses the noise cancellation function of the acoustic telemetry system, in accordance with at least some embodiments. This function is illustrated in greater detail in an alternative embodiment of the adaptive noise-canceling receiver 200 configured as shown in FIG. 3. An acoustic telemetry signal is generated by acoustic transmitter 310, which couples to transfer function 308. Acoustic transmitter 310 does not necessarily represent a single physical transmitter (such as telemetry transmitter 28 in FIG. 1), but is representative of a source for the original acoustic telemetry signal $s_1(t)$ from a first telemetry transmitter. Likewise, the transfer function 308 does not represent a single physical component of the system. The transfer function 308 instead is representative of the distortion that the signal $s_1(t)$ undergoes when propagated through the drillstring from downhole up to the surface. The signal that results from the distortion introduced by propagation of the signal $s_1(t)$ through the drillstring is represented by acoustic telemetry signal $s_2(t)$.

Similarly, environmental noise around the drilling rig is represented in the example of FIG. 3 as noise signal $n_1(t)$. Distortion resulting from the propagation of the noise signal from the source of $n_1(t)$ to the drillstring is represented by transfer function 304. The signal that results from the distortion introduced by propagation of the noise $n_1(t)$ through the environment surrounding the drilling rig (e.g., the ground, and the rig itself) is the noise n(t). Signal $s_2(t)$ and noise n(t) are combined at summing node 306. Summing node is also not a physical summing node within the system, but representative of the superposition of the two signals $s_2(t)$ and n(t), and is shown in FIG. 3 as the equation:

$$s_2(t)+n(t) \tag{2}$$

The combined telemetry and noise signal is received by signal sensor 357, which couples to analog-to-digital converter (ADC) 358. ADC 358 digitizes the output of signal sensor 357 to produce the discrete, combined telemetry and noise signal $s_2(mT)+n(mT)$. Likewise, the noise signal $n_1(t)$ from sensor 302 is digitized by ADC 352 to produce discrete noise signal $n_1(mT)$. In the embodiment of FIG. 3, the output of ADC 352 is coupled to adaptive transversal filter 400, which filters the discrete noise signal $n_1(mT)$ to produce discrete estimated noise $\hat{n}(mT)$. The output of ADC 358 and the output of the adaptive transversal filter 400 both couple to the inputs of summing node 355, the output of which couples to digital-to-analog converter (DAC) 356 and implements the equation:

$$\hat{s}_2(mT)=s_2(mT)+n(mT)-\hat{n}(mT) \tag{3}$$

wherein mT represents a discrete sample m with a sample period or T. The discrete estimated telemetry signal $\hat{s}_2(mT)$ may then be converted back to the continuous time domain by DAC 356, producing the continuous estimated telemetry signal $\hat{s}_2(t)$. The estimated signal $\hat{s}_2(t)$ couples to demodulator module 360, which may then generate a continuous estimated telemetry signal $\hat{s}_1(t)$ from which the transmitted data may be demodulated. The generation of the estimated signal $\hat{s}_1(t)$ may include filtering to account for distortion due to additional noise sources (e.g., noise generated downhole by the drill bit).

Figure 4:
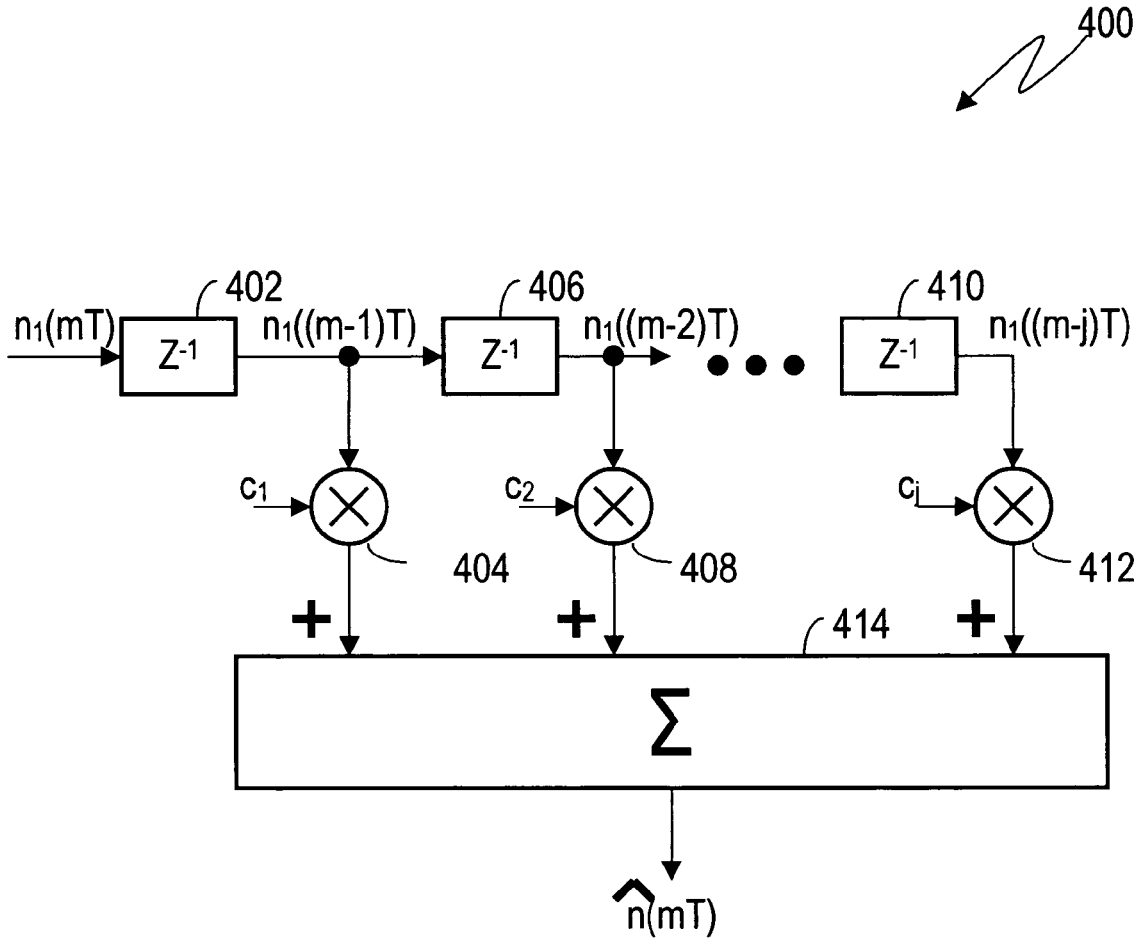
FIG. 4 illustrates a functional diagram of an adaptive transversal filter for an acoustic telemetry system constructed in accordance with at least some embodiments.

The discrete estimated telemetry signal $\hat{s}_2(mT)$ also operates as an error measure that is used as a basis for reducing the error between the estimated telemetry signal $\hat{s}_2(t)$ and the actual telemetry signal $s_2(t)$. The output of the summing node 355 couples to adaptive transversal filter 400, which uses the signal to adjust coefficients within the filter 400. The adaptive transversal filter 400 may be implemented as a finite impulse response (FIR) filter, as illustrated in FIG. 4 in accordance with at least some embodiments of the invention. The discrete noise signal $n_1(mT)$ couples to a first discrete delay line 402, the output of which is the discrete noise signal $n_1((m-1)T)$ from the previous sample period. Likewise, the output of each delay line is the discrete noise signal from progressively older sample periods. Thus, the output of discrete delay line 406 (which is two samples delayed from discrete noise signal $n_1(mT)$) is $n_1((m-2)T)$, and the output of discrete delay line 410 (which is j samples delayed) is $n_1((m-j)T)$. Each delay line couples to a corresponding multiplier (i.e., delay line 402 coupling to multiplier 404, delay line 406 coupling to multiplier 408, and delay line 410 coupling to multiplier 412) and the output of each multiplier couples to summing node 414. Each of the delayed discrete noise signals are multiplied by a corresponding filter tap coefficient c (each tap coefficient coupling to a corresponding multiplier), and the resulting products are then summed to together by summing node 414 to produce the discrete estimated noise signal $\hat{n}(mT)$ at the output of summing node 414.

Figure 5:
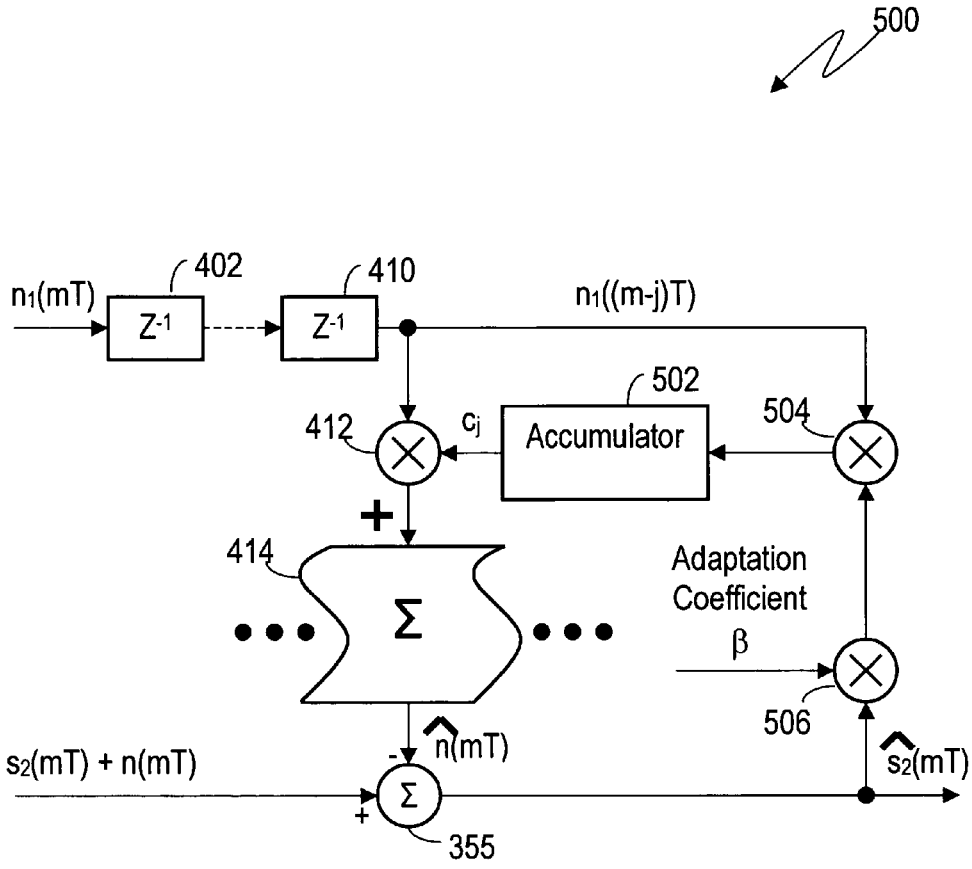
FIG. 5 illustrates a single filter tap of an adaptive transversal filter constructed in accordance with at least some embodiments.

As previously noted, the values of the filter tap coefficients c may be adjusted automatically based on the resulting output of the filter, such that the error between the estimated telemetry signal $\hat{s}_2(t)$ and the actual telemetry signal $s_2(t)$ is reduced. FIG. 5 illustrates the mechanism for adjusting a filter tap from the filter of FIG. 4 constructed in accordance with at least some embodiments, which implements an automatic adjustment of a filter tap coefficient. Delay lines 402 and 410, multiplier 412 and summing node 414 all operate as previously described. The resulting discrete estimated noise $\hat{n}(mT)$ at the output of summing node 414 couples to summing node 355 (also shown in FIG. 3) and is subtracted from the combined discrete telemetry and noise signal $s_2(mT)+n(mT)$ to implement equation (3). The resulting output of summing node 355 is coupled to one of the inputs of multiplier 506, the other input coupled to a programmable adaptation coefficient β. The output of the multiplier 506 is coupled to one of the two inputs to multiplier 504, the other input coupled to the output $n_1((m-j)T)$ of the delay line 410. The output of multiplier 504 is coupled to the input of accumulator 502, the resulting product of multiplier 504 added to a running total maintained in accumulator 502. The output of accumulator 502 is coupled to multiplier 412 and represents the filter tap coefficient $c_j$. The result of this configuration is the coefficient adaptation equation:

$$c_j((m+1)T)=c_j(mT)+\beta\hat{s}_2(mT)n_1((m-j+1)T) \quad (4)$$

wherein mT represents a discrete sample m with a sample period or T. Techniques for the selection of values for the adaptation coefficients and of initial values for the filter tap coefficients are well know in digital signal processing by those skilled in the art and thus are not discussed.

It is noted that a single filter may be used with a plurality of noise signals summed together prior to being presented to the input of the single filter. This and other noise cancellation filter variations will become apparent to one of skill in the art, and are intended to be included within the scope of the invention.

It is further noted that acoustic signaling may be performed in both directions, uphole and downhole. Repeaters may also be included along the drillstring to extend the signaling range. In accordance with at least some embodiments no more than one acoustic transmitter will be operating at any given time. The disclosed noise cancellation strategy is expected to be most advantageous for acoustic receivers located near the surface, as well as for acoustic receivers "listening" to a transmitter located near the surface. However, improved system performance is expected from the use of noise cancellation by all the receivers in the system. It is further noted that the disclosed acoustic telemetry system can be employed for both LWD and MWD systems.

The above disclosure is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An acoustic telemetry system, comprising:

a transmitter to generate an acoustic information signal that propagates along a drillstring; and a receiver to detect an acoustic receive signal from the drillstring, to detect a noise signal at a surface location other than the kelly, and to operate on the acoustic receive signal and the noise signal to produce a modified signal indicative of the acoustic information signal and having a reduced noise content relative to the acoustic receive signal.

2. The system of claim 1, wherein the receiver comprises:

a filter configured to operate on the noise signal to produce an estimated noise component signal; and a summing element to subtract the estimated noise component signal from the acoustic receive signal.

3. The system of claim 2, wherein the filter is adaptive and operable to minimize the noise content of the modified signal.

4. The system of claim 1, wherein the receiver detects multiple noise signals from the surface environment.

5. The system of claim 4, wherein the receiver combines the multiple noise signals with the acoustic receive signal so as to provide the modified signal having a reduced noise content.

6. The system of claim 1, further comprising:

at least one noise sensor that detects said noise signal; and at least one signal sensor that detects said acoustic receive signal.

7. The system of claim 6, wherein the signal sensor comprises an accelerometer.

8. The system of claim 6, wherein the at least one noise sensor comprises one of a sensor set consisting of an accelerometer, a geophone, a microphone, and an antenna.

9. The system of claim 6, wherein the at least one noise sensor is coupled to a drilling rig.

10. The system of claim 6, wherein the at least one noise sensor is acoustically coupled to equipment positioned near a drilling rig.

11. The system of claim 6, wherein the at least one noise sensor is embedded in the ground near a drilling rig.

12. The system of claim 6, wherein the at least one noise sensor is wirelessly coupled to the receiver to provide said noise signal.

13. The system of claim 6, wherein the at least one noise sensor comprises a microphone and the at least one signal sensor comprises an accelerometer.

14. An acoustic telemetry system, comprising:

a transmitter to generate an acoustic information signal that propagates along a drillstring; and a receiver to detect an acoustic receive signal from the drillstring, to detect a noise signal from a surface environment, and to operate on the acoustic receive signal and the noise signal to produce a modified signal indicative of the acoustic information signal and having a reduced noise content relative to the acoustic receive signal, wherein the receiver detects multiple noise signals from the surface environment, and wherein the receiver comprises:

multiple filters, each operating on a respective noise signal to produce an estimated noise component signal; and a summing element to subtract the estimated noise component signals from the acoustic receive signal.

15. The system of claim 14, wherein each of the multiple filters is adaptive.

16. A downhole telemetry method that comprises:

generating a first information-carrying acoustic signal that propagates along a drillstring;

detecting a second information-carrying acoustic signal that correlates to the first information-carrying signal;

receiving a surface noise signal from the drilling site environment with a microphone;

combining the surface noise signal with the second information-carrying signal to produce a third information-carrying signal having a reduced noise content; and demodulating the third information-carrying signal.

17. The method of claim 16, wherein said combining comprises:

adaptively filtering the surface noise signal to obtain a noise estimate signal; and subtracting the estimate signal from the second information-carrying acoustic signal to obtain the third information-carrying signal.

18. The method of claim 16, further comprising:

receiving multiple noise signals from separate sources, wherein the received multiple noise signals includes said surface noise signal; and operating on the multiple noise signals to obtain a noise estimate signal, wherein said combining the surface noise signal with the second information-carrying signal comprises subtracting the noise estimate signal from the second information-carrying signal.

19. The method of claim 18, wherein said operating comprises:

filtering each of the multiple noise signals to obtain a respective noise estimate component; and adding the noise estimate components to obtain the noise estimate signal.

20. The method of claim 16, wherein said receiving a surface noise signal further comprises detecting vibration of a drilling rig.

21. The method of claim 16, wherein said receiving further comprises measuring environmental noise with a geophone inserted into the ground near a drilling rig.

* * * * *